United States Patent [19]

Shero

[11] Patent Number: 4,949,424

[45] Date of Patent: Aug. 21, 1990

[54] CARPET CLEANING SYSTEM

[76] Inventor: William Shero, 30961 Steeplechase, San Juan Capistrano, Calif. 92675

[21] Appl. No.: 365,961

[22] Filed: Jun. 14, 1989

Related U.S. Application Data

[63] Continuation of Ser. No. 301,189, Jan. 23, 1989, abandoned, which is a continuation of Ser. No. 231,700, Aug. 11, 1988, abandoned, which is a continuation of Ser. No. 165,846, Mar. 9, 1988, abandoned, which is a continuation of Ser. No. 857,067, Apr. 29, 1986, abandoned.

[51] Int. Cl.[5] ..... A47L 11/34

[52] U.S. Cl. ..... 15/321; 15/339

[58] Field of Search ..... 15/320, 321, 339, 340

[56] References Cited

U.S. PATENT DOCUMENTS

| | | | |
|---|---|---|---|
| 3,774,261 | 11/1973 | Colt | 15/321 |
| 4,109,340 | 8/1978 | Bates | 15/321 |
| 4,153,968 | 5/1979 | Perkins | 15/321 |
| 4,207,649 | 6/1980 | Bates | 15/321 X |
| 4,284,127 | 8/1981 | Collier et al. | 15/321 X |
| 4,336,627 | 6/1982 | Bascus | 15/340 X |
| 4,433,909 | 4/1984 | Cameron | 15/321 X |

*Primary Examiner*—Chris K. Moore

*Attorney, Agent, or Firm*—Stetina and Brunda

[57] ABSTRACT

An improved carpet cleaning apparatus and method of use is disclosed. The apparatus consists of an internal combustion engine, the exhaust of which is directed through at least one heat exchanger for heating water/-chemical cleaning fluid solution. A source of incoming water passes by a regulator into the inlet end of an engine driven pump, then through a balance pressure regulator valve positioned between the pump and the heat exchanger. A bypass valve intercepts a portion of the heated water after it passes by a thermostat downstream of the heat exchanger and directs this portion of heated water into a conduit leading back to the pump inlet thereby preheating the incoming water. A vacuum pump coupled to the engine draws a vacuum in a separate waste water recovery tank. A hand held carpet cleaner wand injects heated water transported under pressure through a flexible hose through an exhaust nozzle into the surface being cleaned. A vacuum intake port adjacent the exhaust nozzle of the wand vacuums up the residual fluid and directs the fluid back to the recovery tank through another flexible hose. The constantly circulating heated bypass water reduces stagnation of water in the heat exchanger when the wand is deactivated thereby effectively preventing a complete shut down of the system due to overheated water sensed by the thermostat in the heat exchanger.

12 Claims, 2 Drawing Sheets

CARPET CLEANING SYSTEM

This application is a continuation application of Application Ser. No. 07/301,189 (now abandoned), filed 01/23/89, which is a continuation application of Application Ser. No. 07/231,700 (now abandoned), filed 08/11/88, which is a continuation application of Application Ser. No. 07/165,846 (now abandoned), filed 03/09/88, which is a continuation application of Application Ser. No. 067/857,067 (now abandoned), filed on 04/29/86.

BACKGROUND OF THE INVENTION

1. Field of the Invention

This invention relates to carpet cleaning systems.

More particularly, this invention relates to engine driven carpet cleaning systems that utilize the exhaust of the engine to heat water circulating through a heat exchanger. The heated water pumped through the heat exchanger is injected and vacuumed up from a carpet by a wand. The residual waste water is then recovered in a waste water recovery tank associated with the carpet cleaning system.

2. Description of the Prior Art

Carpet cleaning systems that utilize preheated water or "steam" to clean carpets are generally well known in the art. Typically these systems direct a source of water through a pump driven by an engine. The pump then directs water through a safety valve and from there to a heat exchanger. The superheated water exits the heat exchanger, passes through a thermostat and from there the water is directed to a hand held carpet cleaning wand. The wand houses a trigger mechanism that controls the fluid through the wand and out through an exhaust port formed in the end of the wand. The wand also forms a vacuum suction inlet port which directs residual waste water back to a waste water recover tank that is kept under a vacuum by an engine driven blower or vacuum pump. A thermostat downstream of the heat exchanger senses the temperature of the heated water as it exits the heat exchanger. The thermostat typically is set or adjusted to shut down the entire carpet cleaning system if a predetermined water temperature is exceeded. Overheating typically occurs in the heat exchanger apparatus when water stagnates within the exchanger. In state of the art carpet cleaning systems, this phenomena can easily occur when the trigger mechanism in the wand is deactivated backing up water in the heat exchanger. The heat exchanger then overheats the water thereby triggering the thermostat shut off mechanism shutting down the system. When this occurs, the system either has to be evacuated and refilled with fresh water or a considerable time is required for the system to cool down sufficiently to be restarted. Additionally, actuation of the trigger mechanism in the wand causes heat fluctuations due to the erratic movement of water through the heat exchanger. For example, if the trigger mechanism shuts off the water supply to the exhaust port of the wand for a short time period, the water temperature will rise in the heat exchanger. When the trigger is subsequently actuated the wand then momentarily injects a violent burst of super heated steam into the carpet. Wide temperature fluctuations therefore are typical of state of the art carpet cleaners.

The present invention overcomes this deficiency in the prior art by creating a bypass system wherein a portion of the volume of water exiting the heat exchanger is continuously diverted into a bypass conduit and directed into the incoming flow of water toward the inlet to the pump. By creating a continuously circulating flow of preheated water from the heat exchanger back to the inlet supply of water the water within the heat exchanger will not stagnate hence, the water does not typically overheat when the trigger mechanism within the carpet cleaner wand is shut off. Not only does the bypass system reduce premature shut-off of the entire system, it additionally raises the temperature of the incoming water to the water pump by approximately five to twenty degrees Farenheit.

It is readily apparent then that there is less temperature fluctuations within the carpet cleaning system of the present invention when the bypass system is used. Moreover, the safety relief "shut-off" valve downstream of the pump may be set at a higher value since there is a far less likelihood that the system will ever become overpressured due to high temperatures of the water within the heat exchanger. The continuously circulating fluid through the heat exchanger reduces heat and pressure buildup regardless of whether the trigger mechanism within the wand is deactivated.

The bypass system of the present invention reduces the propensity of the heat exchanger from buildingup excessive water temperatures which minimizes heat fluctuation through the carpet cleaning system thereby reducing inadvertant shut down of the entire system due to excessive heat or pressure.

SUMMARY OF THE INVENTION

It is an object of this invention to provide a fluid bypass system to divert a small portion of the volume of water exiting a heat exchanger back to the intake flow of water at the entrance to a pump to reduce excessive build up of heat and pressure within the heat exchanger which could result in shut down of the entire system.

It is another object of this invention to provide a water bypass system which will divert a small portion of preheated water exiting a heat exchanger back to the water inlet upstream of the pump to preheat the incoming water thus minimizing initial start-up delays and heat fluctuations within the system.

A carpet cleaning apparatus is disclosed which utilizes an internal combustion engine having at least one rotary drive shaft extending from the crank case of the engine and at least one exhaust system connected to a combustion chamber of the engine to direct exhaust gases therefrom. A water pump is driven by the engine; the pump forming a first inlet port and a second outlet port which directs a source of water through the pump into at least one heat exchanger. The heat exchanger forms a first liquid opening and a second liquid or water outlet opening. The exhaust system from the internal combustion engine is directed internally of the heat exchanger to heat the water pumped therethrough. A thermostat is positioned downstream of the heat exchanger. The thermostat serves to monitor the water temperature and shut-off the carpet cleaning apparatus in the event of a water overtemperature condition within the heat exchanger.

A bypass valve is connected to a conduit means coupled to the heat exchanger outlet opening downstream of the thermostat. The bypass valve diverts a portion of the heated liquid or water that is pumped through the heat exchanger through a bypass conduit that is connected between the bypass valve and the inlet port of the pump. The portion of heated water diverted through the bypass conduit serves to raise the temperature of the water entering the inlet to the pump.

A waste water recovery tank maintained under vacuum recovers residual water from a cleaned carpet. The tank forms a liquid inlet port thereby with an opening for access to a means to create a vacuum within the tank. A vacuum means such as a blower system is connected via a conduit to the vacuum access opening in the waste water recovery tank.

A first flexible hose is attached downstream of the bypass valve for transporting the heated water under pressure to a carpet cleaning wand, the wand forming a first water exhaust port to direct the heated water under pressure into the surface of the carpet to be cleaned. The wand further forms a second vacuum inlet port behind the exhaust port for subsequently suctioning up the water from the carpet and transporting the suctioned waste water back to the recovery tank through a second flexible hose coupled between the vacuum inlet port formed in the wand and the liquid recovery tank.

A trigger mechanism positioned within the handle of the wand serves to shut off or direct the source of heated pressurized water to the carpet surface. When the trigger mechanism deactivates the wand, the liquid bypass valve continuously diverts water exiting the heat exchanger back to the pump inlet thereby moving water through the heat exchanger to reduce excessive build up of heat within the system.

The bypass system continuously diverts a portion of the heated water exiting the heat exchanger back to the inlet to the pump regardless of whether the trigger mechanism of the wand is activated or not, thereby raising the temperature of the inlet water thus minimizing heat fluctuations throughout the system.

The balance pressure regulator valve positioned between the exit of the pump and the inlet to the heat exchanger may therefore be set at a higher value since the bypass system reduces the possibility of a system shut down due to overtemperature conditions within the heat exchanger which would be sensed by the thermostat downstream of the heat exchanger.

Therefore, an advantage over the prior art is the ability to continuously circulate a portion of the heated fluid exiting the heat exchanger back to the incoming supply water to the pump thus reducing overtemperatures within the system.

Yet another advantage of the present invention over the prior art is the ability to preheat the incoming water to the water pump, thus minimizing heat fluctuations within the carpet cleaning system.

Still another advantage of the present invention over the prior art is the use of dual heat exchangers to more quickly heat up a volume of fluid within the heat exchangers thus increasing the overall efficiencY of the carpet cleaning apparatus.

The above noted objects and advantages of the present invention will be more fully understood upon a study of the description in conjunction with the detailed drawings.

DESCRIPTION OF THE PREFERRED EMBODIMENTS AND BEST MODE FOR CARRYING OUT THE INVENTION

Figure 1:
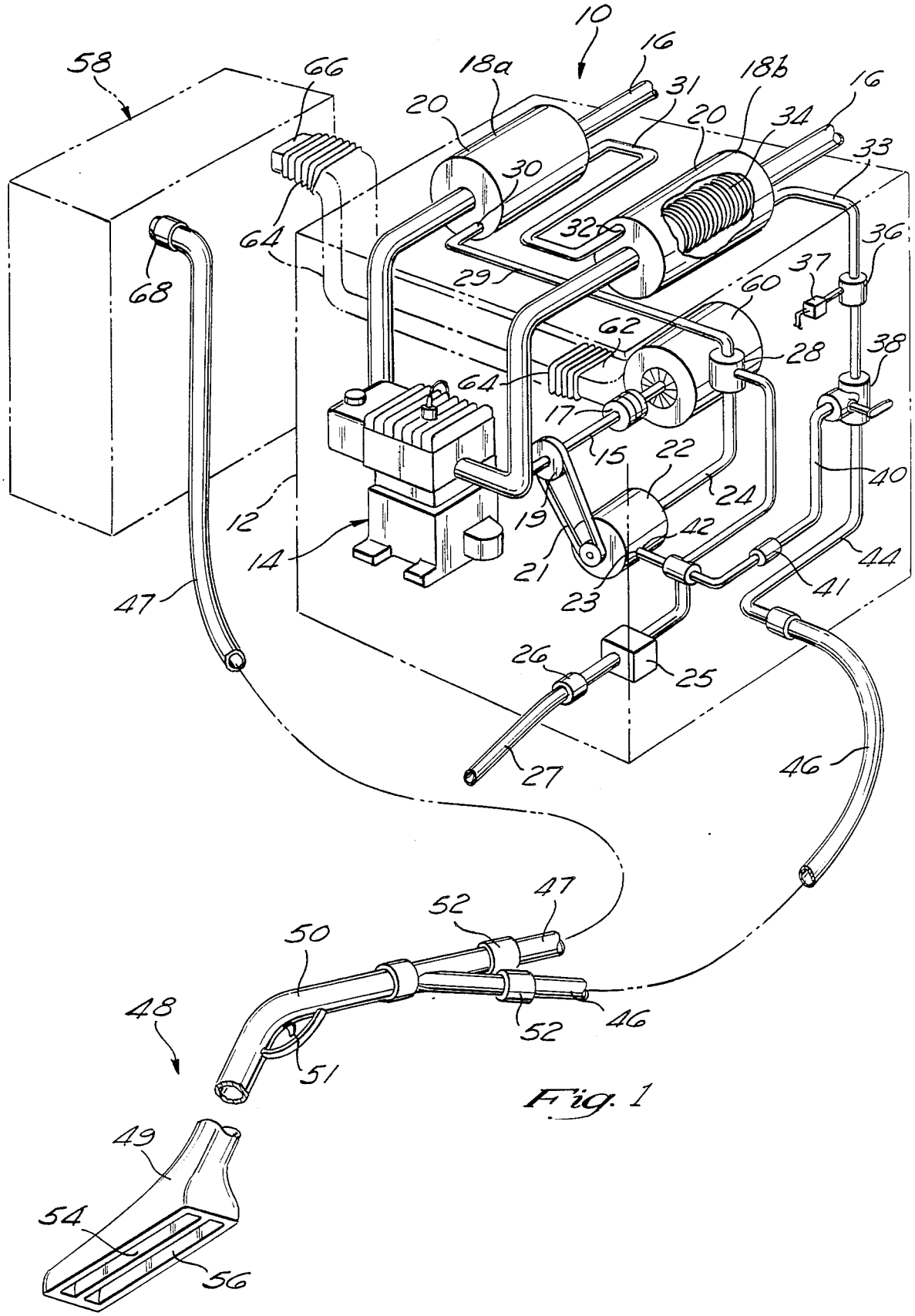
FIG. 1 is a partial schematic, perspective view of the carpet cleaning system.

With reference now to FIG. 1, the improved carpet cleaning apparatus generally designated as 10 consists of a housing 12 which contains a self contained internal combustion engine 14. The engine shown may be any type of internal combustion engine. However, in a preferred embodiment, a Briggs and Stratton engine of about 18 horse power is utilized The engine 14 has a dual exhaust system 16 communicating with a combustion chamber of the engine. The dual exhaust pipes 16 transport hot exhaust gases to the interior of a pair of heat exchangers generally designated **18*a* and 18*b*. The heat exchangers are typically fabricated from stainless steel and define an interior volume through which exhaust gases pass. Each heat exchanger housing 20 preferably contains at least a pair of metal concentric coils 34**; the coils being so configured to receive liquid therein and thermally expose the same to the exhaust gases passing through the heat exchangers.

The crank shaft 15 of the engine 14 is coupled to a water pump 22 by way of a pulley 19 affixed to the crank shaft 15. A belt 21 is connected between pulley 19 and a drive pulley of the pump 22. The pump 22 receives water through a water hose 27 connected to coupling 26. The water is conducted through a conduit to a regulator 25 and then to the intake port 23 of the pump 22. The water exits pump 22 through exit port 13 shown in FIG. 3 into conduit 24 and from there through a conventional balance pressure regulator 28. The water then is transported through conduit 29 to heat exchanger **18*a* through intake 30. The water is then conducted through heater coils 34 in housing 20 and out of the heat exchanger through outlet conduit 31. The conduit 31 enters the inlet side of heat exchanger 18*b* through inlet opening 32 into the heater coils 34 and out through the exit end of the heat exchanger 18*b* through conduit 33**. Water therefore is pumped through each heat exchanger in series, with each heat exchanger adding its heat source to the water.

The pressurized and super-heated water exiting heat exchanger **18*b* through conduit 33 goes through a thermostat 36. The thermostat contains a carpet cleaner safety shut off mechanism. When the thermostat senses an overheated condition, the thermostat automatically shuts down the entire carpet cleaning apparatus (i.e. by selectively disconnecting the electrical ignition from the engine) to prevent bursting of the coils within the heat exchangers 18*a* and 18*b*. The water exits thermostat 36 and enters a bypass valve generally designated as 38. The bypass valve may be any type of valve, however, a preferred embodiment would utilize a needle type valve 38 which diverts a portion of the super-heated pressurized water through bypass conduit 40 into a check valve 41 back into the inlet side of the pump 22 at junction 42. A portion of the super-heated liquid therefore circulates continuously through bypass conduit 40 into the inlet side of the pump 23 thus raising the temperature of the water entering hose 27** through a range of approximately five to twenty degrees Farenheit.

If, for example, the pump 22 forces water through the system at a volume of about 1.5 gallons per minute, the bypass valve 38 would divert approximately 0.05 to 0.25 gallons per minute through the bypass conduit 40 and back into the inlet 23 of pump 22.

The pump 22, for example, typically has a pumping capacity of from 50 to 1000 psi.

Each of the heat exchangers aligned in series, for example, has the capability to heat the incoming water approximately 120 degrees Farenheit, thus the combined heating capability is about 240 degrees Farenheit. Typically the thermostat cut off device would trigger at approximately 230 degrees Farenheit. The system of the present invention therefore has a capacity to maintain a water temperature of about 200 degrees Farenheit with a range of from 200 degrees Farenheit to about 230 degrees Farenheit. The super heated and pressurized water is conducted through conduit 44 downstream of the bypass valve 38 into a flexible hose 46 The flexible hose 46 terminates at end coupling 52 adjacent the handle 50 of a wand generally designated as 48.

A blower 60 is mechanically coupled to drive shaft 15 of engine 14. The blower 60 is driven via drive shaft 15 through a coupling 17 which may, for example, be a flex coupling design to accomodate for slight shaft misalignments. The blower creates a suction via blower inlet port 62. A flexible hose 64 is attached between blower inlet 62 and an opening flange 66 that is positioned near the top of a waste water recovery tank or reservoir generally designated 58. The blower, for example, in the preferred embodiment may be Roots blower producing about 20 HG (280 inches of water lift).

The waste water recovery tank 58 has a flexible suction hose 47 connected between a tank inlet port 68 and a coupling 52 adjacent the handle 50 of wand 48. Water outlet pipe 46 directs superheated water to wand 48 and out through exhaust port 54 at the base 49 of the wand. Residual water is vacuum returned through a suction port 56 formed in base 49 into the suction flexible conduit 47 and from there into tank 58 through coupling 68 near the top of the waste water recovery tank 58.

The waste water recovery tank for example is so configured to hold approximately 70 gallons of waste water. A waste water dump valve is typically located at the base of the recovery tank (not shown).

Figure 2:
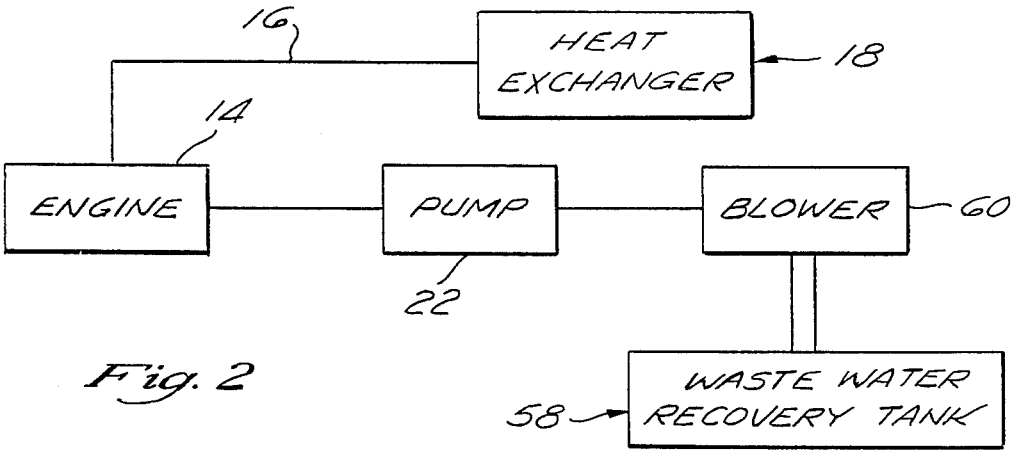
FIG. 2 is a mechanical schematic of the carpet cleaning system illustrating the engine, heat exchanger pump, blower and waste water reservoir tank.

Turning now to FIG. 2, a mechanical schematic illustrates an engine 14 that is mechanically coupled to a pump 22 and blower 60. The engine simultaneously drives both the pump and the blower. As indicated before, pump 22 supplies water under pressure through the heat exchangers 18 and to the wand 48 for dissemination into a carpet for cleaning purposes. The exhaust pipes 16 direct hot exhaust into the interior of the dual heat exchangers **18*a* and 18*b* (FIG. 1) thereby supplying heat to heat the water circulating in coils 34** through the heat exchangers.

Blower 60 creates a suction within the waste water recovery tank to assure that the residual water in the carpet is vacuumed up and withdrawn from the carpet through the wand 48 and deposited into the top of the waste water tank 58. Although a rotary blower can be driven so that either the intake or, as is more common, the exhaust port is at the periphery of the blower, the blower 60 is rotated so that 62 is the inlet port from which suction is created at waste water recovery tank 58 via flexible hose 64.

Figure 3:
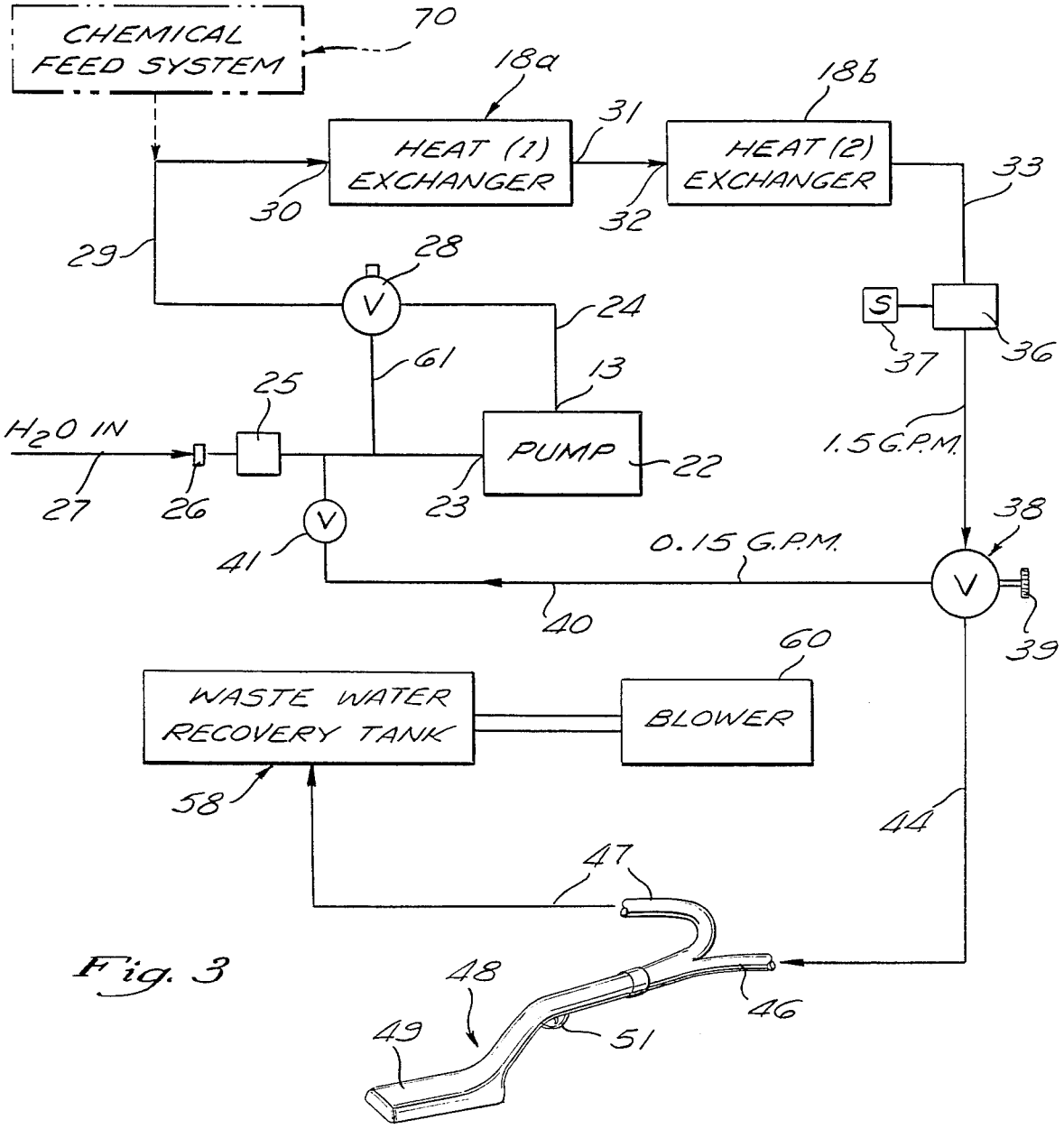
FIG. 3 is a detailed mechanical schematic of the system illustrating most of the components associated with the carpet cleaning apparatus.

With reference now to FIG. 3, a more detailed schematic shows the basic plumbing associated with the overall improved carpet cleaning apparatus.

Water enters the carpet cleaning apparatus 10 through water inlet hose 27 connected to coupling 26. The water then passes through a conventional pressure regulator 25. The regulator serves to control water pressure to pump inlet 23 of pump 22. Water is then pumped through the pump 22 to pump outlet 24 and then through the conventional balance regulator valve 28.

The balance regulator valve 28, in state of the art "steam" carpet cleaners serves a very vital function to relieve over pressure conditions since conventional steam cleaners do not utilize the circulation bypass system as is described in the preferred embodiment of the present invention. Without the bypass system of the present invention, conventional steam cleaners go through widely varying heat fluctuations due to the activation and deactivation of the switching mechanism in the wand as heretofore described If the wand is deactivated during operation of the state of the art steam cleaner for a long period of time, the continued operation of the pump causes the pump to act or pump upon itself since wand deactivation prevents flow through the heat exchangers. As such, the balance regulator valve 28 upon encountering this high pressure condition, opens and allows, the discharge of the pump to be returned via piping 61 to the inlet 23 of the pump and thereby prevents damage to the pump. However, during the opening of the balance regulator valve 28 there is no flow of water through the heat exchangers of prior art systems and thus, the thermostat 36 at the exit of the heat exchanger will sense an overheated condition of the water stagnating within the heat exchangers thereby triggering an automatic shut off of the entire system. In this regard, the thermostat 37 is electrically connected to the ignition of the engine 14 to cause a kill switch condition when over temperature values are developed In either case, the steam cleaning apparatus of the prior art will shut itself down.

The present invention of course, with the circulating bypass system that continually circulates fluid from the exit of the heat exchangers to the inlet of the pump 22 irrespective of wand activation reduces any tendency for an overtemperature condition when the trigger mechanism 51 closes the exhaust port 54 in the wand 48. The thermostat 36 is therefore in effect shielded from sensing rapid high temperature conditions since at least a small portion of water is continuously circulated through the heat exchangers.

In FIG. 3 then, fluid passing through the balance regulator valve 28 then enters conduit 29 and is directed to inlet port 30 of heat exchanger **18*a*. A chemical feed system generally designated as 70 and shown in dotted line may, for example, be utilized to feed chemicals such as detergents to the conduit 29 upstream of the water entering heat exchanger 18*a* through inlet opening 30. Heat exchanger 18*a* has for example, the capability to preheat water within the heater coils 34 to a temperature of about 100 to 120 degrees and since the second heat exchanger 18*b* is plumbed in series therewith, the combined temperature of the fluid exiting heat exchanger outlet 33 from heat exchanger 18*b* maintains a temperature of between 200 and 230 degrees. The superheated water within the conduit 33 then passes past the thermostat 36. The thermostat 36 serves to monitor the temperature of the water exiting the pair of heat exchangers to insure that the temperature of the superheated water is in the range of about 200–230 degrees Farenheit. A temperature actuated switch 37 associated with the thermostat 36 serves to shut down the improved carpet cleaner apparatus if the temperature should reach about 230 degrees Farenheit. It should be pointed out, however, that this would very rarely happen due to the fact that water is diverted from the mainstream and circulated back to the inlet of the pump 23 through bypass conduit 40. Fluid then proceeds toward the bypass valve generally designated as 38 at a flow rate of about, for example, 1.5 gallons per minute The bypass valve 38 in the preferred embodiment would be a needle type valve wherein the amount of diverted fluid may be regulated by the needle valve 39 to divert approximately 0.05 to 0.25 gallons per minute into bypass conduit 40 where the standard flow rate exiting the heat exchanger 18*b* is about 1.5 gallons per minute. Hence, a small portion of the flow rate is diverted through bypass conduit 40 to the incoming water through hose 27. The small volume of diverted superheated fluid then goes through for example a check valve 41 which serves to prevent the bypass fluid from backing up within the bypass line 40. The heated water then intersects the incoming water from hose 27 at any location upstream of the heat exchanger and serves to raise, i.e. preheat the temperature of the incoming water in a range of approximately five to twenty degrees Farenheit. This slight rise in inlet water temperature to the pump 22 serves to minimize the heat fluctuations through the entire system. This of course minimizes the chances for an undesirable burst of superheated steam exiting the exhaust port 54 of wand 48 when the trigger 51** goes from a deactivated position to an activated position after an extended shut down of the system.

It should be pointed out that other types of bypass valves may be utilized other than the needle valve as shown in the preferred embodiment For example, a fluidic type metering orifice valve may be utilized that automatically diverts a portion of a mainstream of superheated water to direct about one-tenth of the volume of water through the bypass conduit 40 into the inlet 23 of pump 22. Of course there are many other types of manually operable valves or electronically operated solenoid valves that can serve the same function as the previously described valves. While these valves are not shown, they are well within the state of the art and may be suitable for use in the present apparatus.

The waste water recovery tank or reservoir as heretofore stated contains about 70 gallons of water in the preferred embodiment. The size of the waste water recovery tank of course is determined by the space availability. The blower 60 mechanically coupled to the drive shaft 15 serves to create a vacuum within the waste water recovery tank so that the spent fluid may be returned through inlet 56 in wand head 49 and be retained in the recovery tank. The recovery tank is typically emptied in an approved toxic waste dump area.

It would be obvious to one skilled in the art to utilize a single heat exchanger in combination with exhaust gases to generate heat to superheat water flowing through the heat exchanger.

It would additionally be obvious to utilize different types of power plants such as electric motors or diesel engines to mechanically drive the pump and blower to activate the improved carpet cleaning system.

It would be obvious to use means other than exhaust gases to heat water within the heat exchanger without departing from the intent of the present invention.

The basic purpose of the invention is to continuously divert a small portion of the superheated water exiting the heat exchanger system back toward the incoming water source to the inlet of the pump 22 to both reduce heat fluctuations within the system and to reduce periodic shut down of the carpet cleaning system during abrupt heat surges within the heat exchangers caused when the actuation trigger 51 of wand 48 interrupts the flow of exhausted superheated water to the carpet to be cleaned.

Of course, the bypass circulation system operates continuously regardless of whether the trigger is activated or deactivated thereby providing a constant flow of water through the heat exchangers thus limiting heat fluctuations sensed by the thermostat 36 and preventing any possibility of overtemperatures or pressures within these heat exchanger devices.

It will, of course, be realized that various modifications can be made in the design and operation of the present invention without departing from the spirit thereof. Thus, the principal construction and mode of operation of the invention has been explained in what is now considered to represent its best embodiments, and has been illustrated and described. It should be understood that within the scope of the dependent claims the invention may be practiced otherwise than as specifically illustrated and described.

What is claimed is:

1. A carpet cleaning apparatus comprising:

a heat exchanger having an inlet port and an outlet port;

a heat source for providing heat to said heat exchanger;

an inlet conduit fluidly connected to the inlet port of said heat exchanger;

a liquid supply means for passing liquid into said inlet conduit;

an outlet conduit fluidly connected to the outlet port of said heat exchanger;

a pump having an inlet and an outlet, said pump being positioned and operatively connected to said apparatus so as to pump liquid in a first direction through said inlet conduit, through said heat exchanger and through said outlet conduit;

an applicator wand having an inlet port fluidly connected to said outlet conduit and an exhaust port for expelling liquid onto a carpet;

a trigger means alternately positionable in at least first and second positions, such that, (a) when in said first position, said trigger means will operate to halt the flow of liquid through said applicator wand and the resultant expulsion of liquid through said exhaust port and (b) when in said second position said trigger means will allow the flow of liquid through said applicator wand and the resultant expulsion of liquid through said exhaust port;

a bypass conduit fluidly connecting said at least one outlet conduit to said at least one inlet conduit;

a bypass valve positioned in said outlet conduit, said bypass valve being sized and configured such that, (a) when said trigger means is in said first position, the bypass valve will allow passage of liquid from said one outlet conduit into said bypass conduit, thereby permitting said pump to continue circulation of liquid through said heat exchanger although the flow of liquid through the applicator wand and out of the exhaust port is halted; and (b) when said trigger is in said second position, the bypass valve will divert a fraction of the liquid flowing through said one outlet conduit into said bypass conduit, thereby causing said fraction of liquid to be recirculated through said heat exchanger as outflow of liquid through the applicator wand and out of the exhaust port continues.

2. The carpet cleaning apparatus of claim 1 further comprising:

a thermostat shut-off device operative to monitor the temperature of water exiting said heat exchanger and to shut off said heat source when the water exiting the heat exchanger is determined to be in excess of a predetermined maximum temperature.

3. The carpet cleaning apparatus of claim 1 wherein the pump is positioned on the inlet conduit and the bypass conduit is a fluid connection between the outlet conduit and the inlet of the pump.

4. The apparatus of claim 3 further comprising a pressure relief valve positioned in the inlet conduit between the outlet port of said pump and the inlet of said heat exchanger to relieve excess pressure therefrom.

5. The apparatus of claim 1 wherein said heat source and said heat exchanger are cooperative to heat the liquid passing through said heat exchanger to a temperature of 200–230 degrees Fahrenheit.

6. The apparatus of claim 1 wherein the fraction of liquid diverted through said by-pass conduit to the inlet conduit is sufficient in volume, relative to the overall volume of liquid passing through the inlet conduit to increase the temperature of liquid entering the heat exchanger by approximately 20 degrees Fahrenheit.

7. The apparatus of claim 1 wherein said by-pass valve comprises a needle valve which is sized, configured and positioned to divert said fraction of liquid from said at least one heat exchanger outlet conduit into said by-pass conduit.

8. The apparatus of claim 1 further comprising a check valve in said by-pass conduit to prevent backflow of liquid through said by-pass conduit toward said outlet conduit.

9. The apparatus of claim 1 wherein said by-pass valve comprises a fluidic valve operative to automatically divert said fraction of liquid from said heat exchanger outlet conduit into said by-pass conduit.

10. The apparatus of claim 1 further comprising a vacuum means connected to said wand for extracting water from said carpet.

11. The apparatus of claim 10 further comprising a liquid recovering tank for collecting liquid extracted by said vacuum.

12. In the use of a carpet cleaning apparatus comprising a heat exchanger, at least one liquid inlet conduit leading to said heat exchanger, at least one liquid outlet conduit leading from said heat exchanger, an application wand connected to said outlet conduit for applying said liquid to a carpet and a pump for pumping said liquid through said inlet conduit, through said heat exchanger, through said outlet conduit and into said wand, a method of facilitating even and thorough heating of said liquid by said heat exchanger, said method comprising the step of:

continuously diverting a fraction of liquid exiting the heat exchanger back into the inlet conduit leading to said heat exchanger, thereby causing the diverted fraction of liquid to be recirculated through said heat exchanger.

* * * * *